US005430429A

United States Patent [19]

Nakamura et al.

[11] Patent Number: 5,430,429

[45] Date of Patent: Jul. 4, 1995

[54] CERAMIC RESISTOR WHEREIN A RESISTANCE FILM IS EMBEDDED

[75] Inventors: Kazutaka Nakamura; Hiroyuki Kubota; Yasunobu Yoneda; Akinori Nakayama; Tohru Tominaga; Tomoaki Ushiro, all of Nagaokakyo, Japan

[73] Assignee: Murata Manufacturing Co., Ltd., Kyoto, Japan

[21] Appl. No.: 127,747

[22] Filed: Sep. 27, 1993

[30] Foreign Application Priority Data

Sep. 29, 1992 [JP] Japan ..... 4-259837
Sep. 29, 1992 [JP] Japan ..... 4-259838

[51] Int. Cl.[6] ..... H01C 1/02

[52] U.S. Cl. ..... 338/226; 338/248; 338/249; 338/252; 338/273; 338/312; 338/322; 338/332

[58] Field of Search ..... 338/226, 248, 249, 252, 338/253, 273, 274, 275, 276, 312, 322, 332

[56] References Cited

U.S. PATENT DOCUMENTS 4,786,888 11/1988 Yoneda et al. ..... 338/275 X
5,257,003 10/1993 Mahoney ..... 338/332 X

*Primary Examiner*—Marvin M. Lateef
*Attorney, Agent, or Firm*—Ostrolenk, Faber, Gerb & Soffen

[57] ABSTRACT

A resistor 1 in which at least one resistance film 4 is embedded in a ceramic sintered body 3, glass is diffused into the sintered body 3 to form a glass diffusion layer 6, and both end faces 4*a* and 4*b* of the resistance film 4 are respectively exposed to both end faces 3*a* and 3*b* of the ceramic sintered body 3.

16 Claims, 2 Drawing Sheets

CERAMIC RESISTOR WHEREIN A RESISTANCE FILM IS EMBEDDED

BACKGROUND OF THE INVENTION

1. Field of the Invention

The present invention relates generally to a resistor having a structure capable of preventing the variation in the resistance characteristics, improving the environmental resistance to humidity or the like, and further increasing the capacity of power and the mechanical strength, and more particularly, to a resistor having a structure in which at least one resistance film is embedded in a ceramic sintered body.

2. Description of the Prior Art

Conventionally, a cermet resistor mainly composed of a ruthenium oxide or a ruthenium compound has been widely used as a resistance element superior in precision. In fabricating such a resistor, a resistive paste composed of the above described ruthenium oxide or the like is printed on the surface of, for example, an alumina substrate to form a thick resistance film, and the resistance film is baked at temperatures of 800° to 900° C. A glass paste is applied to the surface of the resistance film on the alumina substrate and then, is baked to form a glass film. The glass film increases the environmental resistance to humidity or the like.

In the above described conventional resistor, however, the resistance film is directly coated with the glass film, so that the resistance value is liable to change and the characteristics are liable to vary. In addition, a pinhole may, in some cases, be formed in the glass film. In such a case, water or the like enters the resistor from the pinhole in an atmosphere of high humidity, to degrade the resistance characteristics. Furthermore, in the above described conventional resistor, the alumina substrate, the resistance film and the glass film differ in the coefficient of thermal expansion, so that the adhesive properties of the resistance film to the substrate are low. As a result, a large capacity of power is not obtained. The limit of the capacity of power is approximately 100 mW.

SUMMARY OF THE INVENTION

The present invention has been made in view of the above described conventional conditions and has for its object to provide a resistor capable of avoiding the variation in the resistance characteristics, improving the environmental resistance to humidity or the like, and obtaining a large capacity of power.

In accordance with a wide aspect of the present invention, there is provided a resistor comprising a ceramic sintered body containing glass and at least one resistance film which is embedded in the sintered body and whose end faces are exposed to the outer surface of the ceramic sintered body.

The above described glass is not particularly limited, provided that it has a softening point which is not more than the sintering temperature in cofiring ceramics and the resistance film and has insulating properties. In addition, it is desirable that a material superior in acid resistance and solvent resistance is used as a material constituting the above described glass. Examples of a method of containing the above described glass include a method of previously containing glass in a ceramic material before sintering and a method of diffusing glass at the time of sintering. Although it is possible to use, as the latter method, methods such as a method of adding a varnish or the like to glass or a glass material to bring the glass or the glass material into a paste and making the paste obtained adhere to the surface of a sintered body and then, heat-treating the same and a method of heat-treating a glass material in a molten and evaporated atmosphere to diffuse glass and make the glass penetrate, the latter method is not particularly limited to the methods.

Furthermore, in the present invention, the content of the above described glass is changed, thereby to make it possible to arbitrarily control the resistance value. The content of the glass can be controlled by suitably setting the amount of the glass prepared, the atmospheric density at the time of heat treatment, the temperature, the time or the like. As the content of the glass is increased, the resistance value is increased.

The above described resistor can be fabricated by, for example, a suitable method such as a method of laminating a plurality of ceramic green sheets while being separated by the above described resistance film and cofiring a laminated body obtained along with the resistance film to obtain a sintered body and then, diffusing glass into the sintered body from the exterior.

In the above described resistor according to the present invention, the resistance film is embedded in the sintered body. Moreover, the glass is contained in the sintered body. Consequently, the resistance film is surrounded with ceramics, thereby to make it possible to reduce the variation in the resistance value in the conventional resistor in which the resistance film is directly coated with glass. In addition, the resistance film is surrounded with ceramics, thereby to make it possible to enhance the heat dissipating properties and reduce the distortion due to the difference in the coefficient of thermal expansion. Consequently, it is possible to realize a larger capacity of power. Furthermore, the glass can be embedded in a fine hole included in the sintered body because the glass is contained in the sintered body. Consequently, it is possible to improve the environmental resistance to humidity or the like and lengthen the life of the resistor. Additionally, the mechanical strength of the resistor is increased by containing the glass.

In accordance with another particular aspect of the present invention, there is provided a resistor comprising a ceramic sintered body formed by containing ZnO as a main component and containing as a subcomponent a total of 0.1 to 10% by weight of at least one of zinc borosilicate glass and lead zinc borosilicate glass and at least one resistance film which is embedded in the ceramic sintered body and whose both end faces are exposed to the outer surface of the ceramic sintered body.

The reason why the content of the above described zinc borosilicate glass and lead zinc borosilicate glass is limited to the above described particular ratio is that the effect of improving the resistance characteristics is not sufficiently obtained if the content of the glass is less than 0.1% by weight, while the reaction between the sintered body and the resistance film easily occurs if it exceeds 10% by weight, so that the characteristics greatly varies and the capacity of power is decreased.

The sintered body mainly composed of ZnO containing zinc borosilicate glass and/or lead zinc borosilicate glass in the above described particular range can be obtained by preparing a plurality of ceramic green sheets mainly composed of a material obtained by adding to ZnO zinc borosilicate glass and/or lead zinc borosilicate glass, laminating the ceramic green sheets while being separated by the above described resistance film and cofiring a laminated body obtained along with the resistance film.

Also in the above described resistor provided in accordance with another aspect of the present invention, the resistance film is surrounded with a ceramic material, as in the above described resistor provided in accordance with a wide aspect of the present invention, thereby to make it possible to enhance the heat dissipating properties and reduce the distortion due to the difference in the coefficient of thermal expansion. Consequently, it is possible to realize a large capacity of power. In addition, it is possible to reduce the variation in the characteristics due to the change in the resistance value and enhance the environmental resistance such as the humidity resistance.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
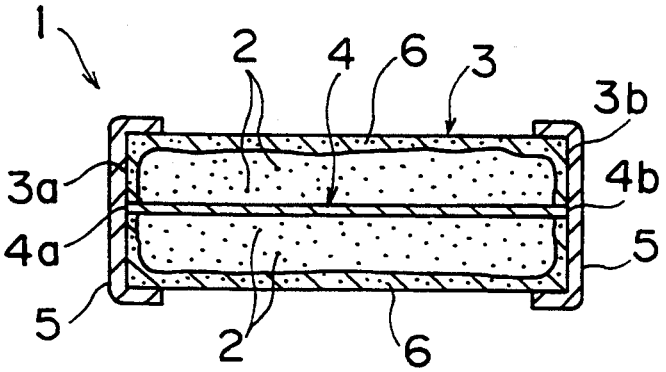
FIG. 1 is a cross sectional view for explaining a resistor according to one embodiment of the present invention.
Figure 2:
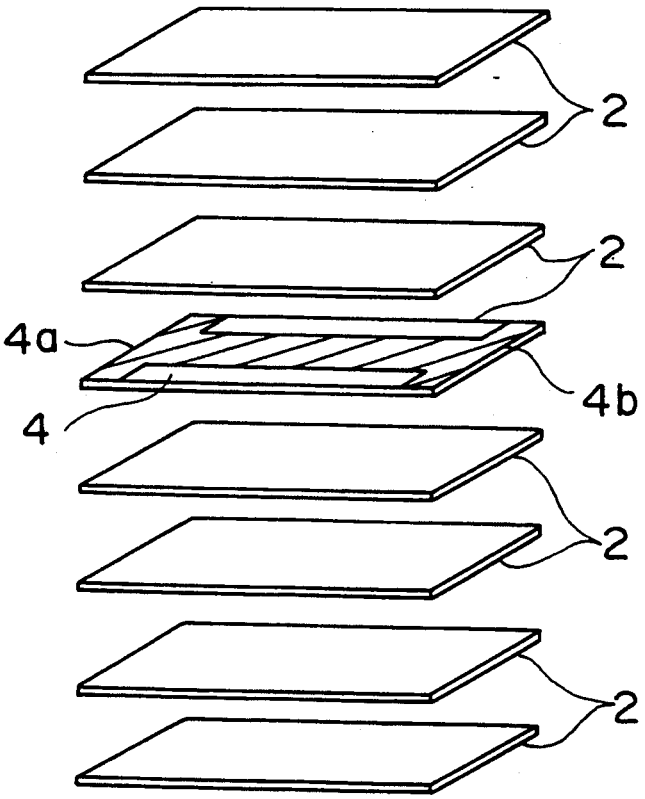
FIG. 2 is an exploded perspective view for explaining a method of fabricating the resistor shown in FIG. 1.

FIGS. 1 and 2 are diagrams for explaining a resistor according to one embodiment of the present invention.

In FIGS. 1 and 2, reference numeral 1 denotes a cermet resistor according to the present embodiment. The resistor 1 is constructed by embedding a resistance film 4 composed of a ruthenium oxide or its compound in a ceramic sintered body 3 of an approximately rectangular parallelopiped shape. Left and right end faces 4a and 4b of the resistance film 4 are respectively exposed to left and right end faces **3*a* and 3*b* of the sintered body 3, and the remaining end faces of the resistance film 4 are sealed in the sintered body 3. In addition, the left and right end faces 3*a* and 3*b* of the sintered body 3 are respectively coated with outer electrodes 5 composed of an Ag - Pd alloy, and the outer electrodes 5 are electrically connected respectively to the end faces 4*a* and 4*b* of the resistance film 4**.

Furthermore, the above described sintered body 3 is formed by laminating a plurality of ceramic green sheets 2 mainly composed of a material obtained by containing ZnO as a main component and mixing a subadditive with ZnO to form a laminated body and cofiring the laminated green sheets and the resistance film. In this case, the above described resistance film 4 is patterned on the upper surface of one of the plurality of ceramic green sheets 2 which is positioned in the center in the direction of thickness, and the remaining ceramic green sheets 2 are overlapped in a sandwich shape with the ceramic green sheet 2 on which the resistance film 4 is formed.

A glass layer 6 is formed in a surface portion of the above described sintered body 3. The glass layer 6 is formed by containing the above described sintered body 3 and glass powder in a ceramic container and heat-treating the sintered body and the glass powder at a temperature which is not less than the softening point of the glass powder while rotating the ceramic container to diffuse glass and make the glass penetrate into the sintered body 3.

Description is now made of the function and the effect of the present embodiment.

In the resistor 1 according to the present embodiment, the resistance film 4 is embedded and the glass layer 6 is formed in the sintered body 3, so that the resistance film 4 is surrounded with ceramics. Consequently, the need for the conventional coating with glass can be eliminated. The variation in the characteristics due to the change in the resistance value can be reduced because no coating with glass is required. In addition, the glass is diffused into an outer surface portion of the sintered body 3, so that the glass can be embedded in a hole in the sintered body 3, thereby to make it possible to solve the problem of a pinhole. Accordingly, it is possible to improve the environmental resistance to humility or the like and improve the life characteristics.

Additionally, the above described resistance film 4 is surrounded with a ceramic material, so that it is possible to improve the heat dissipating properties and reduce the distortion due to the difference in the coefficient of thermal expansion. The capacity of power can be improved because the heat dissipating properties are improved and the distortion is reduced. In this connection, the capacity of power is approximately 100 mW in the conventional resistance element, while a capacity of power which is not less than two to ten times that in the conventional resistance element is obtained in the resistor 1 according to the present embodiment even when the size of the resistor 1 is made smaller than that of the conventional resistance element.

Furthermore, in the present embodiment, the glass layer 6 is formed in the sintered body 3, thereby to make it possible to improve the flexural strength of the resistor 1 as well as to control the resistance value by changing the amount of diffusion of the glass, so that the resistor can be used for more applications. In addition, a plurality of resistance films 4 can be laminated while being separated by ceramic layers, thereby to make it possible to freely design various resistors which differ in the resistance value using materials having the same pattern and the same resistance, so that the resistor can be used for more applications also in this respect.

Although in the above described embodiment, description was made by taking as an example a case where the glass layer 6 is formed in the outer surface portion of the sintered body 3, the present invention is not limited to the same. For example, the glass may be diffused over the entire region of the sintered body 3 or may be made to adhere to the surface of the sintered body 3.

Description is now made of one method of fabricating the resistor 1 according to the present embodiment.

First, ceramic powder is formed by containing ZnO as a main component and mixing Bi, Sb, Co and Mn in the form of their oxides with ZnO such that their contents are respectively 1.0 mole %, 0.5 mole %, 0.5 mole % and 0.5 mole % in terms of $Bi_2O_3$, $Sb_2O_3$, CoO and MnO. Pure water is added to the powder, and the powder is ground and mixed in a ball mill, to form a slurry.

The above described slurry is then evaporated and dried, and is calcined at a temperature of 750° C. for two hours. A calcined product obtained is coarsely powdered, and pure water is added to coarse powder obtained, and the coarse powder is finely powdered in the ball mill, to form a ceramic raw material. A solvent obtained by mixing ethyl alcohol and toluene in a ratio of 6:4 is added to the raw material, and the raw material and the solvent are mixed in the ball mill, to form a slurry.

The above described slurry is used, to form a green sheet having a thickness of 70 μm by the Doctor blade process, and the green sheet is dried and then, is cut to predetermined sizes, to form a lot of ceramic green sheets 2 in a rectangular shape.

On the other hand, a vehicle and glass are added to a composition obtained by mixing $RuO_2$, $Ru_2Pb_2O_7$ and $Ru_2Bi_2O_7$ in molar ratios of 6:2:2, to from a resistive paste. The resistive paste is printed on the upper surface of one of the above described ceramic green sheets 2, to form a resistance film 4. In this case, the resistance film 4 is so formed that left and right end faces 4*a* and 4*b* thereof are respectively positioned in left and right outer edges of the ceramic green sheet 2, and the remaining end faces thereof are positioned inside of the ceramic green sheet 2.

The plurality of ceramic green sheets 2 are then superimposed and laminated on the upper surface and the lower surface of the ceramic green sheet 2 on which the resistance film 4 is formed, and are pressed by applying a pressure of 2t/cm$^2$, thereby to form a laminated body. The laminated body is then cut to predetermined sizes, and the cut laminated body is heated to a temperature of 400° C. to scatter a binder and then, is raised and heated to a temperature of 930° C. and is sintered for three hours, thereby to obtain a sintered body 3. The sintered body 3 thus obtained is barrel-polished.

The above described sintered body 3 is contained in a ceramic container, and a predetermined amount of borosilicate glass powder (containing 60% by weight of ZnO, 20% by weight of $B_2O_3$ and 20% by weight of $SiO_2$) is contained in the ceramic container. The ceramic container is heated to a temperature of 800° C. which is not less than the softening point of the glass powder while rotating the ceramic container in this state, to heat-treat the sintered body 3 and the glass powder for two hours. The above described glass powder is diffused and made to penetrate into a surface portion of the sintered body 3 to adhere thereto by this heat treatment, thereby to form a glass layer 6.

Finally, a conductive paste containing Ag and Pd in a ratio of 7:3 (in a weight ratio) is applied to left and right end faces 3*a* and 3*b* of the above described sintered body 3, and the conductive paste is baked at a temperature of 850° C. for ten minutes, to form outer electrodes 5. The outer electrodes 5 and the left and right end faces 4*a* and 4*b* of the resistance film 4 are electrically connected to each other. Consequently, the resistor 1 according to the present embodiment is fabricated.

TABLE 1

| SAMPLE No. | DIFFUSION OF GLASS AND HEAT TREATMENT FOR DIFFUSION | |
|---|---|---|
| 1 | GLASS IS NOT DIFFUSED | NO HEAT TREATMENT |
| 2 | GLASS IS NOT DIFFUSED | GLASS IS HEAT-TREATED |
| 3 | DIFFUSION OF GLASS 0.3 wt % | |
| 4 | DIFFUSION OF GLASS 0.5 wt % | |
| 5 | DIFFUSION OF GLASS 0.7 wt % | |
| 6 | DIFFUSION OF GLASS 1.0 wt % | |
| 7 | DIFFUSION OF GLASS 1.5 wt % | |

TABLE 2

| SAMPLE No. | RESISTANCE (Ω) | 3 CV | POWER (mW) | α | FLEXURAL STRENGTH (kg) | RATE OF CHANGE IN RESISTANCE USING PRESSURE COOKER (%) |
|---|---|---|---|---|---|---|
| 1 | 157 | 12 | 1340 | 1.02 | 2.6 | 5.2 |
| 2 | 153 | 13 | 1290 | 1.01 | 2.3 | 5.6 |
| 3 | 234 | 13 | 1360 | 1.00 | 3.2 | 2.2 |
| 4 | 575 | 12 | 1420 | 1.01 | 3.3 | 1.9 |
| 5 | 961 | 11 | 1450 | 1.00 | 3.8 | 1.3 |
| 6 | 1433 | 9 | 1530 | 1.00 | 4.3 | 1.1 |
| 7 | 2919 | 11 | 1480 | 1.01 | 4.1 | 1.1 |

Description is now made of a test carried out so as to confirm the effect of the resistor 1 according to the present embodiment. In carrying out the test, a lot of samples No. 3 to No. 7 are first prepared as examples in the above described fabricating method by setting the amount of addition of borosilicate glass powder in the range of 0.3 to 1.5% by weight to change the amount of diffusion and the amount of adhesion of the glass, as shown in Table 1 and Table 2. Measurements of the resistance value (Ω), the variation in the resistance value 3CV (3 δ average×100%), the capacity of power (mW), and the linearity of the resistance value (α) are made with respect to the above described samples No. 3 to No. 7. The linearity is found from an equation $\alpha = 1/\log(R_{1mA}R_{0.1mA})$. In the equation, $R_{1mA}$ and $R_{0.1mA}$ are respectively resistance values measured by causing currents of 1 mA and 0.1 mA to flow. In addition, measurements of the flexural strength kg and the rate of change in the resistance value % after 96 hours using a pressure cooker (at a pressure of 2 atom and a relative humidity of 100%) to which 1 W of power is applied are made with respect to the above described samples No. 3 to No. 7. For comparison, a comparative sample No. 1 in which the glass is neither diffused nor heat-treated and a comparative sample No. 2 in which the glass is not diffused but only heat-treated are prepared, and the same measurements are made with respect to the comparative samples.

As apparent from Table 2, in both the comparative samples No. 1 and No. 2 in which the glass is not diffused, the measured values of the flexural strength are respectively 2.6 kg and 2.3 kg, and the measured values of the rate of change in the resistance value are respectively 5.2% and 5.6%, whose values cannot be satisfied. On the other hand, in the respective samples No. 3 to No. 7 in which the glass is diffused, the measured values of the variation in the resistance value are 9.0 to 13%, the measured values of the capacity of power are 1360 to 1530 mW, and the measured values of the linearity are 1.00 to 1.01, whose values can be satisfied. Moreover, the measured values of the flexural strength are 3.2 to 4.3 kg, and the measured values of the rate of change in the resistance value are 2.2 to 1.1%, whose values are significantly improved, as compared with the values in above described comparative samples, so that it is found that the life characteristics are improved. Furthermore, in the above described samples No. 3 to No. 7, the larger the amount of diffusion of the glass is, the larger the resistance value is. This proves that the resistance value can be arbitrarily set by controlling the amount of diffusion.

Figure 3:
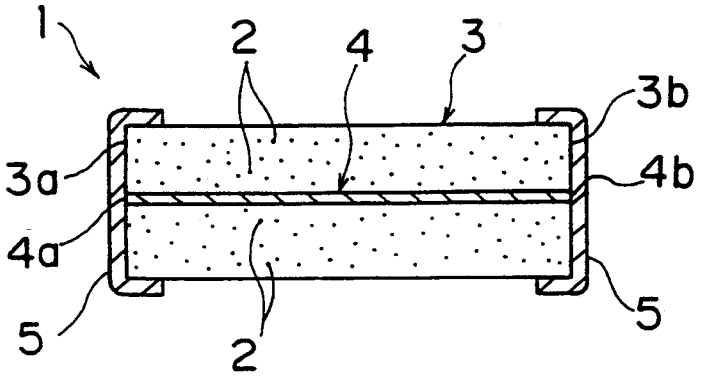
FIG. 3 is a cross sectional view for explaining a resistor according to another embodiment of the present invention.
Figure 4:
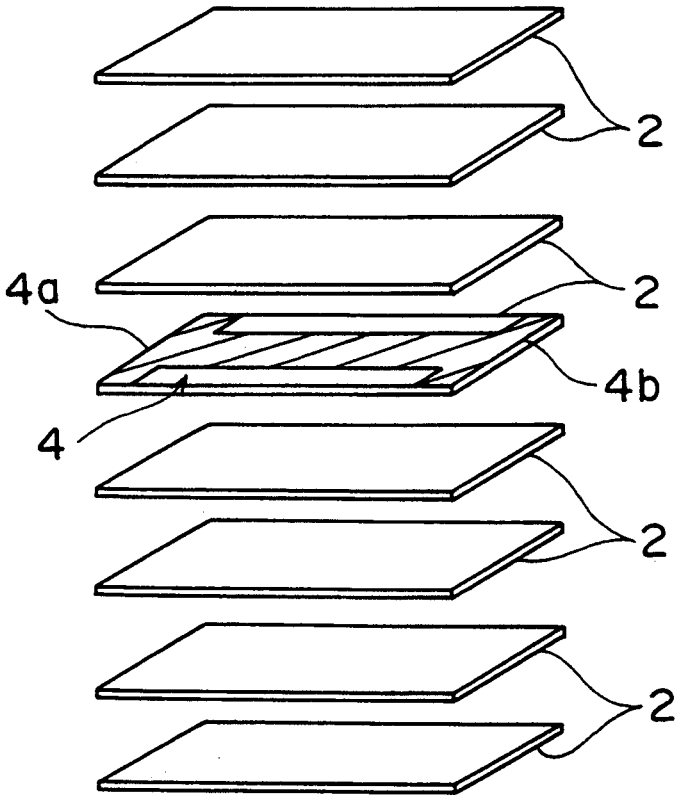
FIG. 4 is an exploded perspective view for explaining a method of fabricating the resistor according to the embodiment shown in FIG. 3.

FIGS. 3 and 4 are diagrams for explaining a resistor according to another embodiment of the present invention.

In FIGS. 3 and 4, reference numeral 11 denotes a cermet resistor according to the present embodiment. The resistor 11 is constructed by embedding a resistance film 14 composed of a ruthenium oxide or its compound in a ceramic sintered body 13 in an approximately rectangular parallelopiped shape. Left and right end faces 14*a* and 14*b* of the resistance film 14 are respectively exposed to left and right end faces 13*a* and 13*b* of the sintered body 13, and the remaining end faces of the resistance film 14 are sealed in the sintered body 13. In addition, the left and right end faces 13*a* and 13*b* of the sintered body 13 are respectively coated with outer electrodes 15 composed of an Ag - Pd alloy, and the outer electrodes 15 are electrically connected respectively to the end faces 14*a* and 14*b* of the resistance film 14.

Furthermore, the above described sintered body 13 is formed by laminating a plurality of ceramic green sheets 12 to form a laminated body and cofiring the laminated green sheets and the resistance film 14. In this case, the above described resistance film 14 is patterned on the upper surface of one of the plurality of ceramic green sheets 12 which is positioned in the center in the direction of thickness, and the remaining ceramic green sheets 12 are overlapped in a sandwich shape with the ceramic green sheet 12 on which the resistance film 14 is formed.

The above described sintered body 13 is constituted by a ceramic material obtained by containing ZnO powder as a main component and adding to the ZnO powder zinc borosilicate glass powder and/or lead zinc borosilicate glass powder as a subcomponent, and the amount of addition of the above described glass powder is in the range of a total of 0.1 to 10% by weight.

Description is now made of the function and the effect of the present embodiment.

In the resistor 11 according to the present embodiment, the resistance film 14 is embedded in the sintered body 13, so that the resistance film 14 is surrounded with ceramics. Consequently, the need for the conventional coating with glass can be eliminated. The variation in the characteristics due to the change in the resistance value can be reduced because no coating with glass is required. In addition, the problem of a pinhole can be solved, thereby to make it possible to improve the environmental resistance to humidity or the like and improve the life characteristics.

Additionally, a ceramic material obtained by containing ZnO as a main component and adding to ZnO zinc borosilicate glass and/or lead zinc borosilicate glass is used for the above described sintered body 13, thereby to make it possible to lower the sintering temperature. The resistance film 14 thus obtained is superior in the adhesive properties to the sintered body 13. Moreover, the resistance film 14 is surrounded with the ceramic material, so that it is possible to improve the heat dissipating properties and reduce the distortion due to the difference in the coefficient of thermal expansion. The capacity of power can be improved because the heat dissipating properties are improved and the distortion is reduced. In this connection, the capacity of power is approximately 100 mW in the conventional resistance element, while a capacity of power which is not less than ten times that in the conventional resistance element is obtained in the resistor 11 according to the present embodiment while making the size of the resistor 11 smaller than that of the conventional resistance element.

Furthermore, in the present embodiment, the need for the conventional process of coating a glass paste and then, sintering the same can be eliminated. The fabrication cost can be reduced because no process of coating a glass paste and then, sintering the same is required. In addition, a plurality of resistance films 14 can be laminated while being separated by ceramic layers, thereby to make it possible to freely design various resistors which differ in the resistance value using the resistance films having the same pattern and by repeating the same process, so that the sintered body can be used for more applications.

Description is now made of one method of fabricating the resistor according to the present embodiment.

First, ZnO powder is mixed with zinc borosilicate glass powder or lead zinc borosilicate glass powder, to form ceramic powder. The glass powder is so added that the total of the contents of ZnO, $Pb_2O_3$, $B_2O_3$ and $SiO_2$ is 0.1 to 10% by weight. Pure water is added to the above described ceramic powder, and the powder is ground and mixed in a ball mill, to form a slurry.

The above described slurry is then evaporated and dried, and is calcined at a temperature of 750° C. for two hours. A calcined product obtained is coarsely powdered, and pure water is added to coarse powder obtained, and the coarse powder is finely powdered in the ball mill, to form a ceramic raw material. A solvent obtained by mixing ethyl alcohol and toluene in a ratio of 6:4 (in a volume ratio) is added to the ceramic raw material, and the raw material and the solvent are mixed in the ball mill, to form a slurry.

The above described slurry is used, to form a green sheet having a thickness of 70 μm by the Doctor blade process, and the green sheet is dried and then, is cut to predetermined sizes, to form a lot of ceramic green sheets 12 in a rectangular shape.

A vehicle and glass are then added to a composition obtained by mixing $RuO_2$, $Ru_2Pb_2O_7$ and $Ru_2Bi_2O_7$ in ratios of 6:2:2 (in molar ratios), to from a resistive paste. The resistive paste is printed on the upper surface of one of the above described plurality of ceramic green sheets 12, to form a resistance film 14. In this case, the resistance film 14 is so formed that left and right end faces 14*a* and 14*b* thereof are respectively positioned in left and right edges of the ceramic green sheet 12, and the remaining end faces thereof are positioned inside of the ceramic green sheet 12.

The plurality of ceramic green sheets 12 are then superimposed and laminated on the upper surface and the lower surface of the ceramic green sheet 12 on which the resistance film 14 is formed, and are pressed by applying a pressure of 2t/cm$^2$, thereby to form a laminated body. The laminated body is then cut to predetermined sizes, and the cut laminated body is heated to a temperature of 400° C. to scatter a binder and then, is raised and heated to a temperature of 920° C. and is sintered for three hours, thereby to obtain a sintered body 13. The sintered body 13 thus obtained is barrel-polished.

A conductive paste containing Ag and Pd in a ratio of 7:3 (in a weight ratio) is applied to left and right end faces 13*a* and 13*b* of the above described sintered body 13, and the conductive paste is baked at a temperature of 850° C. for ten minutes, to form outer electrodes 15. The outer electrodes 15 and the left and right end faces 14*a* and 14*b* of the resistance film 14 are electrically connected to each other. Consequently, the resistor 11 according to the present embodiment is fabricated.

TABLE 3

| No. | AMOUNT OF ADDITION (wt %) | COMPOSITION RATIO OF GLASS ZnO | $Pb_2O_3$ | $B_2O_3$ | $SiO_2$ |
|---|---|---|---|---|---|
| 11 | 0.1 | 70 | — | 15 | 15 |
| 12 | 0.3 | 70 | — | 15 | 15 |
| 13 | 0.5 | 70 | — | 15 | 15 |
| 14 | 1.0 | 70 | — | 15 | 15 |
| 15 | 3.0 | 70 | — | 15 | 15 |
| 16 | 5.0 | 70 | — | 15 | 15 |
| 17 | 10.0 | 70 | — | 15 | 15 |
| 18* | 30.0 | 70 | — | 15 | 15 |
| 19* | 50.0 | 70 | — | 15 | 15 |
| 20 | 1.0 | 60 | — | 20 | 20 |
| 21 | 1.0 | 60 | — | 10 | 30 |
| 22 | 1.0 | 50 | — | 40 | 10 |
| 23 | 0.1 | 69 | 1.0 | 15 | 15 |
| 24 | 0.3 | 69 | 1.0 | 15 | 15 |
| 25 | 0.5 | 69 | 1.0 | 15 | 15 |
| 26 | 1.0 | 69 | 1.0 | 15 | 15 |
| 27 | 3.0 | 69 | 1.0 | 15 | 15 |
| 28 | 5.0 | 69 | 1.0 | 15 | 15 |
| 29 | 10.0 | 69 | 1.0 | 15 | 15 |
| 30* | 30.0 | 69 | 1.0 | 15 | 15 |
| 31* | 50.0 | 69 | 1.0 | 15 | 15 |
| 32 | 1.0 | 69.9 | 0.1 | 15 | 15 |
| 33 | 1.0 | 69.5 | 0.5 | 15 | 15 |
| 34 | 1.0 | 69 | 1.0 | 10 | 20 |

TABLE 4

| No. | SINTERING PROPERTY | Resistance (Ω) | 3 CV | POWER (mW) |
|---|---|---|---|---|
| 11 | 0 | 0.15K | 7 | 1330 |
| 12 | 0 | 0.34 | 6 | 1380 |
| 13 | 0 | 0.58K | 10 | 1250 |
| 14 | 0 | 1.14K | 12 | 1330 |
| 15 | 0 | 3.56K | 13 | 1280 |
| 16 | 0 | 8.94K | 11 | 1370 |
| 17 | 0 | 45.6K | 21 | 1140 |
| 18* | 0 | 427K | 35 | 517 |
| 19* | 0 | 3.5M | 45 | 240 |
| 20 | 0 | 0.98 | 8 | 1350 |
| 21 | 0 | 1.27K | 9 | 1440 |
| 22 | 0 | 1.95K | 12 | 1330 |
| 23 | 0 | 0.12K | 5 | 1350 |
| 24 | 0 | 0.28K | 7 | 1250 |
| 25 | 0 | 0.48K | 9 | 1240 |
| 26 | 0 | 0.95K | 11 | 1260 |
| 27 | 0 | 2.85K | 12 | 1280 |
| 28 | 0 | 6.94K | 15 | 1210 |
| 29 | 0 | 36.7K | 17 | 1180 |
| 30* | 0 | 543K | 33 | 684 |
| 31* | 0 | 2.2M | 53 | 110 |
| 32 | 0 | 1.23K | 7 | 1360 |
| 33 | 0 | 1.01K | 6 | 1310 |
| 34 | 0 | 1.24K | 11 | 1220 |

Description is now made of a test carried out so as to confirm the effect of the resistor 11 according to the present embodiment. In carrying out the test, a lot of samples No. 11 to No. 34 are prepared as examples in the above described fabricating method by setting the amount of addition of borosilicate glass powder in the range of 0.3 to 1.5% by weight to change the amount of diffusion and the amount of adhesion of the glass, as shown in Table 3 and Table 4. Measurements of the resistance value (Ω), the variation in the resistance value 3CV (3 δ/average×100%), and the capacity of power (mW) are made with respect to the respective samples. In the tables, a sample with a "*" mark indicates a sample outside of the range of the present invention.

As apparent from Table 3 and Table 4, in the samples Nos. 18, 19, 30 and 31 in which the amount of addition of the glass powder exceeds 10% by weight, the measured values of the variation in the resistance value 3 CV are as large as 33 to 53%, and the measured values of the capacity of power are lowered to 110 to 684 mW, so that the characteristics are degraded due to the reaction between the sintered body and the resistance film. On the other hand, in the samples Nos. 11 to 17, Nos. 20 to 29 and Nos. 32 to 34 in which the amount of addition of the glass powder is within the range of the present invention, the measured values of the variation in the resistance value 3 CV are as small as 5 to 21%, and the measured values of the capacity of power are significantly improved to 1140 to 1440 mW.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A resistor comprising:

a ceramic sintered body containing glass; and at least one resistance film which is embedded in said sintered body and whose both end faces are exposed to the outer surface of the ceramic sintered body.

2. A resistor comprising:

a ceramic sintered body containing glass; and at least one resistance film which is embedded in said sintered body and whose both end faces are exposed to the outer surface of the ceramic sintered body;

3. A resistor comprising:

a ceramic sintered body containing glass; and at least one resistance film which is embedded in said sintered body and whose both end faces are exposed to the outer surface of the ceramic sintered body;

4. A resistor comprising:

a ceramic sintered body containing glass; and at least one resistance film which is embedded in said sintered body and whose both end faces are exposed to the outer surface of the ceramic sintered body;

5. A resistor comprising:

a ceramic sintered body containing glass; and at least one resistance film which is embedded in said sintered body and whose both end faces are exposed to the outer surface of the ceramic sintered body;

6. The resistor according to claim 7, wherein said glass is at least one of zinc borosilicate glass and lead zinc borosilicate glass.

7. The resistor according to claim 6, wherein a pair of outer electrodes is formed on the outer surface of said sintered body, and the pair of outer electrodes is electrically connected to said resistance film which is led out to the outer surface of the sintered body.

8. The resistor according to claim 6, wherein both the end faces of said resistance film are respectively exposed to both end faces opposed to each other of said sintered body.

9. The resistor according to claim 4, wherein said glass is diffused to be contained in a region in the vicinity of the outer surface of the sintered body.

10. The resistor according to claim 4, wherein said glass is diffused to be contained over the entire region of the sintered body.

11. The resistor according to claim 4, wherein said sintered body is constituted by a ceramic material mainly composed of ZnO.

12. The resistor according to claim 4, wherein said glass is at least one of zinc borosilicate glass and lead zinc borosilicate glass.

13. The resistor according to claim 12, wherein said sintered body is constituted by a ceramic material mainly composed of ZnO.

14. A resistor comprising:

a ceramic sintered body formed by containing ZnO as a main component and containing as a subcomponent a total of 0.1 to 10% by weight of at least one of zinc borosilicate glass and lead zinc borosilicate glass; and at least one resistance film which is embedded in said ceramic sintered body and whose both end faces are exposed to the outer surface of the ceramic sintered body.

15. The resistor according to claim 9, further comprising a pair of outer electrodes formed on the outer surface of said ceramic sintered body, said pair of outer electrodes being electrically connected to both the end faces of said resistance film which are exposed to the outer surface of the ceramic sintered body.

16. The resistor according to claim 9, wherein both the end faces of said resistance film are exposed to both end faces opposed to each other of said sintered body.

* * * * *